US011015390B2

(12) United States Patent
Maier et al.

(10) Patent No.: US 11,015,390 B2
(45) Date of Patent: May 25, 2021

(54) CONTROL CENTER FOR AN AERIAL DEVICE WITH CONTROL LEVER

(71) Applicant: IVECO MAGIRUS AG, Ulm (DE)

(72) Inventors: Thomas Maier, Stuttgart (DE); Markus Schmid, Stuttgart (DE); Roland Mandel, Stuttgart (DE); Kristian Karlovic, Stuttgart (DE); Philipp Pomiersky, Stuttgart (DE); Jens Kraemer, Ulm/Donau (DE)

(73) Assignee: IVECO MAGIRUS AG, Ulm (DE)

( * ) Notice: Subject to any disclaimer, the term of this patent is extended or adjusted under 35 U.S.C. 154(b) by 0 days.

(21) Appl. No.: 16/099,653

(22) PCT Filed: May 23, 2017

(86) PCT No.: PCT/EP2017/062472
§ 371 (c)(1),
(2) Date: Nov. 7, 2018

(87) PCT Pub. No.: WO2017/202872
PCT Pub. Date: Nov. 30, 2017

(65) Prior Publication Data

US 2019/0153779 A1 May 23, 2019

(30) Foreign Application Priority Data

May 23, 2016 (IT) ..... 102016000052457

(51) Int. Cl.
*E06C 5/04* (2006.01)
*B66F 11/04* (2006.01)
(Continued)

(52) U.S. Cl.
CPC ..... *E06C 5/04* (2013.01); *B66F 11/046* (2013.01); *G05G 1/01* (2013.01); *G05G 9/04785* (2013.01); *G05G 2009/04777* (2013.01)

(58) Field of Classification Search
CPC ..... E06C 5/04; B66F 11/046; G05G 1/01; G05G 9/04785; G05G 2009/04777
See application file for complete search history.

(56) References Cited

U.S. PATENT DOCUMENTS 4,775,029 A * 10/1988 MacDonald ..... B66F 11/046 182/2.1
5,286,159 A * 2/1994 Honma ..... B25J 5/007 182/2.11
(Continued)

FOREIGN PATENT DOCUMENTS

CA 2946013 A1 * 5/2017 ..... B66F 17/006
EP 0 867 595 A2 9/1998

OTHER PUBLICATIONS

American Heritage® Dictionary of the English Language, Fifth Edition. Copyright © 2016 by Houghton Mifflin Harcourt Publishing Company. Published by Houghton Mifflin Harcourt Publishing Company. All rights reserved. Downloaded from: https://www.thefreedictionary.com/flat (Year: 2016).*
(Continued)

*Primary Examiner* — Daniel P Cahn
*Assistant Examiner* — Candace L Bradford
(74) *Attorney, Agent, or Firm* — McCracken & Gillen LLC

(57) ABSTRACT

Control center for an aerial device, said aerial device comprising a main boom part mounted on a turret, the main boom part being inclinable around a horizontal axis in a first inclination movement, rotatable around a vertical axis in a rotation movement, and extendable and retractable in a first
(Continued)

telescopic movement, wherein the control center comprises a first control device configured for controlling the first inclination movement and the rotation movement of the main boom part, and a second control device comprising at least a first control lever for controlling the first telescopic movement.

9 Claims, 4 Drawing Sheets

(51) Int. Cl.
*G05G 9/047* (2006.01)
*G05G 1/01* (2008.04)

(56) References Cited

U.S. PATENT DOCUMENTS 6,543,578 B1 * 4/2003 Merz ..... B66C 13/56
182/148
2005/0224439 A1 * 10/2005 Bean ..... B66F 11/046
212/280
2006/0061122 A1 * 3/2006 Billger ..... B66F 9/20
296/65.07
2010/0302017 A1 * 12/2010 Guglielmo ..... B66F 11/04
340/407.2
2015/0203078 A1 * 7/2015 Kraemer ..... E06C 5/38
254/423
2016/0221808 A1 * 8/2016 Babel ..... B62D 33/06
2019/0153779 A1 * 5/2019 Maier ..... E06C 5/04

OTHER PUBLICATIONS

Patent Cooperation Treaty, International Search Report and Written Opinion for International Application No. PCT/EP2017/062472, dated Jun. 19, 2017, 13 pages.

* cited by examiner

CONTROL CENTER FOR AN AERIAL DEVICE WITH CONTROL LEVER

CROSS-REFERENCE TO RELATED APPLICATIONS

The present application claims priority to PCT International Application No. PCT/EP2017/062472 filed on May 23, 2017, which application claims priority to Italian Patent Application No. 102016000052457 filed May 23, 2016, the entirety of the disclosures of which are expressly incorporated herein by reference.

STATEMENT RE: FEDERALLY SPONSORED RESEARCH/DEVELOPMENT

Not applicable

TECHNICAL FIELD

The present invention relates to a control center for an aerial device.

BACKGROUND ART

One example for such an aerial device is a telescopic turnable ladder of a firefighting vehicle. It comprises at least a main ladder set mounted on a turret with a first end, such that it can be inclined around a horizontal axis and rotated around a vertical turret axis. The main ladder set shall be denoted as a main boom part in the following, while the inclination of this main boom part shall be denoted as a first inclination movement. Moreover, the main boom part can be telescopically extended and retracted along its longitudinal extension direction in a telescopic movement, which shall be denoted as first telescopic movement. In some embodiments, an extension boom part is mounted by a hinge mounting at the second end of the main boom part, such that the extension boom part can be inclined with respect to the main boom part in a second inclination movement. The extension boom part represents an extension of the ladder set to increase its range in a radial direction from the turret, as well as the accessible height from the ground.

The different movements of the main boom part and, if present, the extension boom part are controllable by a human operator located at a control center which comprises different control means. A very common and approved control means is a joystick, which is a control lever which can be tilted around two axes perpendicular to each other. Each axis corresponds to one degree of freedom to be controlled. In the present case, a joystick can be used for controlling the first inclination movement, i. e. the inclination of the main boom part, and the rotation movement of the main boom part around the turret.

For controlling areal devices of the above kind, a second control device is present which can be operated independent from the joystick described above. In a common solution, this second control device is another joystick, such that two joysticks are present which can be operated by the operator's hands. This second joystick is provided at least for controlling the telescopic movement of the main boom part and, if such is present, the inclination movement of the extension boom part. In cases in which such an extension boom part can also be telescopically extended and retracted along its longitudinal extension direction in an independent telescopic movement, the second joystick can be switched to an operation mode in which this second telescopic movement is controlled.

It has turned out that this concept does not provide an intuitive and ergonomic way of controlling the complex movements of the ladder, and it demands high operation skills. Controlling two different joysticks with a left and right end to be controlled along two perpendicular control axes, respectively, has turned out to be too complex in a situation with different stress factors under high pressure, which is the case in a rescue situation.

DISCLOSURE OF INVENTION

It is therefore an object of the present invention to provide a control center for an aerial device of the above kind which represents a control concept that allows an intuitive control of the aerial device along all degrees of freedom, such that the control is simplified and possible in an ergonomic way even in a stress situation.

This object is achieved by a control center comprising the features of claim 1.

According to the present invention, the second control device comprises at least a first control lever for controlling the first telescopic movement (i. e. the telescopic movement of the main boom part). It is possible to arrange this control lever such that it can be operated by a finger of an operator's hand. This is a very intuitive and ergonomic way of controlling this movement.

The first control lever represents a control means with an operating direction (i. e. the tilting movement of the lever) corresponding to the actual movement of the mechanical element to be controlled in a more intuitive way. For example, no sideward movement of the control device is necessary to control, for example, an actual movement of an element which does not comprise a lateral component. Therefore this control concept is highly ergonomic.

According to a preferred embodiment of the present invention, the aerial device further comprises an extension boom part mounted to the second end of the main boom part by a hinge mounting and being inclinable around a horizontal hinge axis with respect to the main boom part in a second inclination movement, and the second control device comprises control means for controlling the second inclination movement.

According to a one embodiment, this control means for controlling the second inclination movement comprise a second control lever for controlling the second inclination movement. The second control lever can be arranged next to the first control lever such that the first and second control levers can be operated independently by different fingers of the operator.

According to another embodiment, the control means for controlling the second inclination movement comprise a switch for changing an operation mode of the first control lever between a first mode of controlling the first telescopic movement and a second mode of controlling the second inclination movement. Thus only one lever is necessary for controlling these two movements. The term "switch" shall denote any switching device which is capable of being set into two different states, i. e. to be switched from a first state to a second state and back, corresponding to the different operation modes, including switching devices which remain in their present switching position after being switched, and also switching devices which are set back to their original switching state when no mechanical pressure by the operator is applied. Such switching devices can include switch buttons which keep a first state (corresponding to a first operation mode) when no pressure is applied, and which are switched into a second state (corresponding to a second operation mode) when mechanical pressure is applied, and which return to the first state when the pressure is released.

According to still another preferred embodiment of the present invention, the extension boom part is extendable and retractable along its longitudinal extension direction in a second telescopic movement, and the second control device further comprises control means for controlling the second telescopic movement. This embodiment represents a control concept for controlling an aerial device with an additional degree of freedom, namely a telescopic extension of the extension boom part, which can be elongated or retracted. For controlling this additional movement, the second control device is also provided.

According to one preferred embodiment, these control means for controlling the second telescopic movement comprise a third control lever. This third control lever can be disposed next to the first control lever and/or, if present, the second control lever. By operating this third control lever, the second telescopic movement of the extension boom part can be performed.

According to another preferred embodiment, these control means for controlling the second telescopic movement comprise a switch for changing an operation mode of the first control lever or the second control lever into a third mode of controlling the second telescopic movement.

It is possible to arrange the control levers in a row next to each other or with a separating element between them. That is, they can be arranged directly adjacent to one another or with any kind of separating body, for example, another lever disposed between them.

The control levers may comprise tilting axes that are disposed horizontally and which are identical or parallel to each other. Moreover, the third control lever can also have a tilting axis parallel to the tilting axis of the first control lever and the second control lever, or having a tilting axis identical to the first and second control lever.

According to another preferred embodiment of the present invention, the control center comprises an armrest, with a second control device being disposed at a front end of the armrest. This allows the operator to take a comfortable and stress-free working position when controlling the aerial device, with one arm resting on the armrest, and the hand of this arm operating the second control device.

More preferably, the front end of the armrest comprises a bulge representing a handrest. The hand of the operator can rest on top of the bulge, with his/her fingers resting on the respective levers of the second control device to control them.

More preferably, a switch for changing an operation mode of the first control lever or the second control lever is disposed laterally at an inner side of the armrest or handrest. In this case it is possible to operate this switch by the thumb of the operator, while the other control levers can be operated by the index finger and the middle finger of the operator's hand resting on the end of the armrest or the handrest.

According to another preferred embodiment of the present invention, the second control device comprises at least one additional switch disposed laterally at an inner side of the armrest or handrest.

Preferably, this additional switch is a movement restriction control switch for activating/deactivating a movement restriction of the aerial device or a communication control switch for activating/deactivating a communication function of the aerial device. Different switches with different operating functions may be present next to each other at the inner side of the armrest or handrest, each to be operated by the operator in a position with the hand resting on the end of the armrest or on the handrest.

The invention is further related to a control center of the above kind, comprising an operator's seat, with a backrest and two left and right armrests disposed laterally at two opposite sides of the backrest, with a first control device being disposed on one of the armrests, and a second control device being disposed on the other armrest.

Preferably the first control device comprises a joystick.

Moreover, the invention is further related to a firefighting vehicle, comprising a turnable ladder as an aerial device, and a control center of the above kind.

BRIEF DESCRIPTION OF THE DRAWINGS

The present invention will be elucidated more clearly with respect to preferred embodiments of the present invention, which will be described hereinafter by means of the following figures.

BEST MODE FOR CARRYING OUT THE INVENTION

Figure 1:
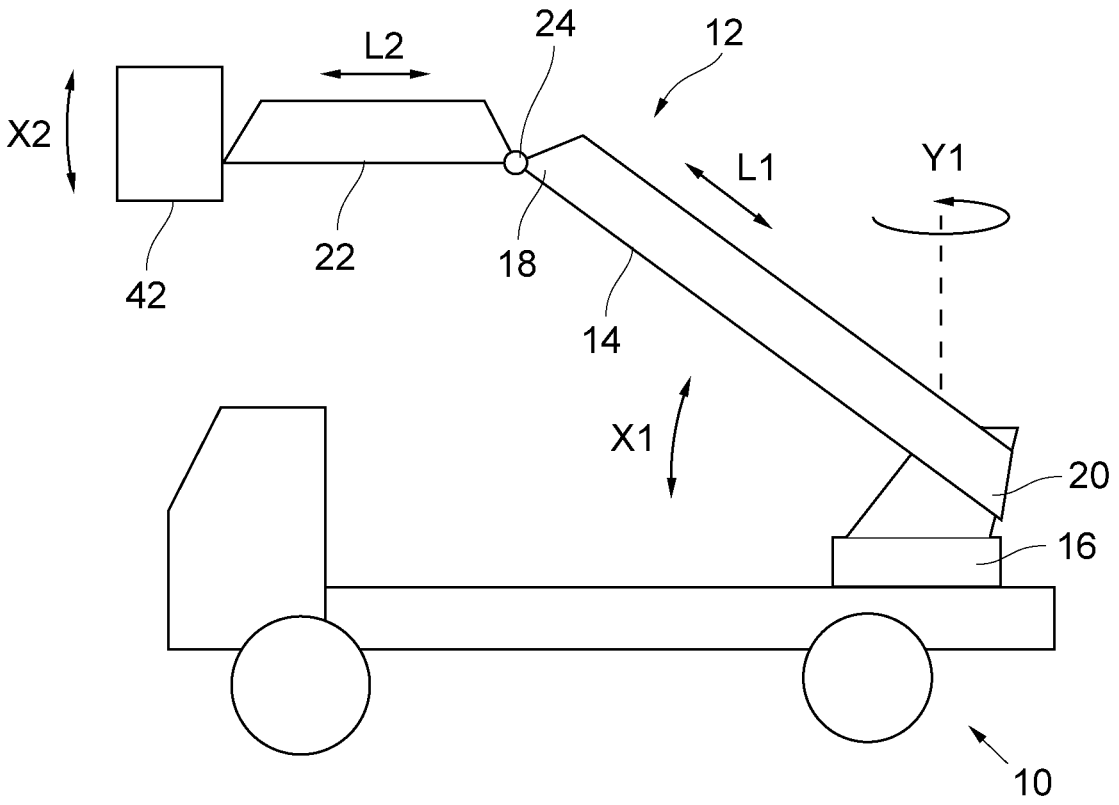
FIG. 1 is a schematic view of a firefighting vehicle according to a first embodiment of the present invention, demonstrating the different degrees of freedom of a turnable ladder as an aerial device mounted on top of the firefighting vehicle.

FIG. 1 shows a firefighting vehicle 10 comprising a turnable ladder 12 representing an aerial device which is mounted on top of a rear portion of the firefighting vehicle 10. The turnable ladder 12 comprises a main boom part 14 which is mounted with one end on a turret 16 to be rotatable around a vertical axis. A corresponding rotation movement shall be denoted as Y1 in the following, as it is the case in FIG. 1. Moreover, the main boom part 14 can be inclined around a horizontal axis located at or near the turret 16 in a first inclination movement X1. By this inclination movement X1, the other end of the main boom part 14 can be lifted or lowered. The main boom part 14 represents a main ladder set of the turnable ladder 12, which can be extended or retracted along its longitudinal extension direction in a first telescopic movement L1. In this first telescopic movement L1, the different elements of the ladder set (not shown in detail in FIG. 1) are shifted with regard to one another such that the free (second) end 18 of the main boom part moves away or approaches the first end 20 which is mounted on the turret 16.

At the second end 18 of the main boom part 14, an extension boom part 22 is mounted by a hinge mounting 24 having a horizontal hinge axis. The extension boom part 22 is inclinable around the hinge axis 24 with respect to the main boom part 14 in a second inclination movement X2. In the present embodiment, the extension boom part 22 is also represented by a ladder set comprising different ladder elements that can be telescopically extended and retracted along the longitudinal extension direction of the extension boom part 22 in a second telescopic movement L2 to elongate or to shorten the length of the extension boom part 22. At the front top end of the extension boom part 22, a rescue cage 42 is mounted.

Figure 2:
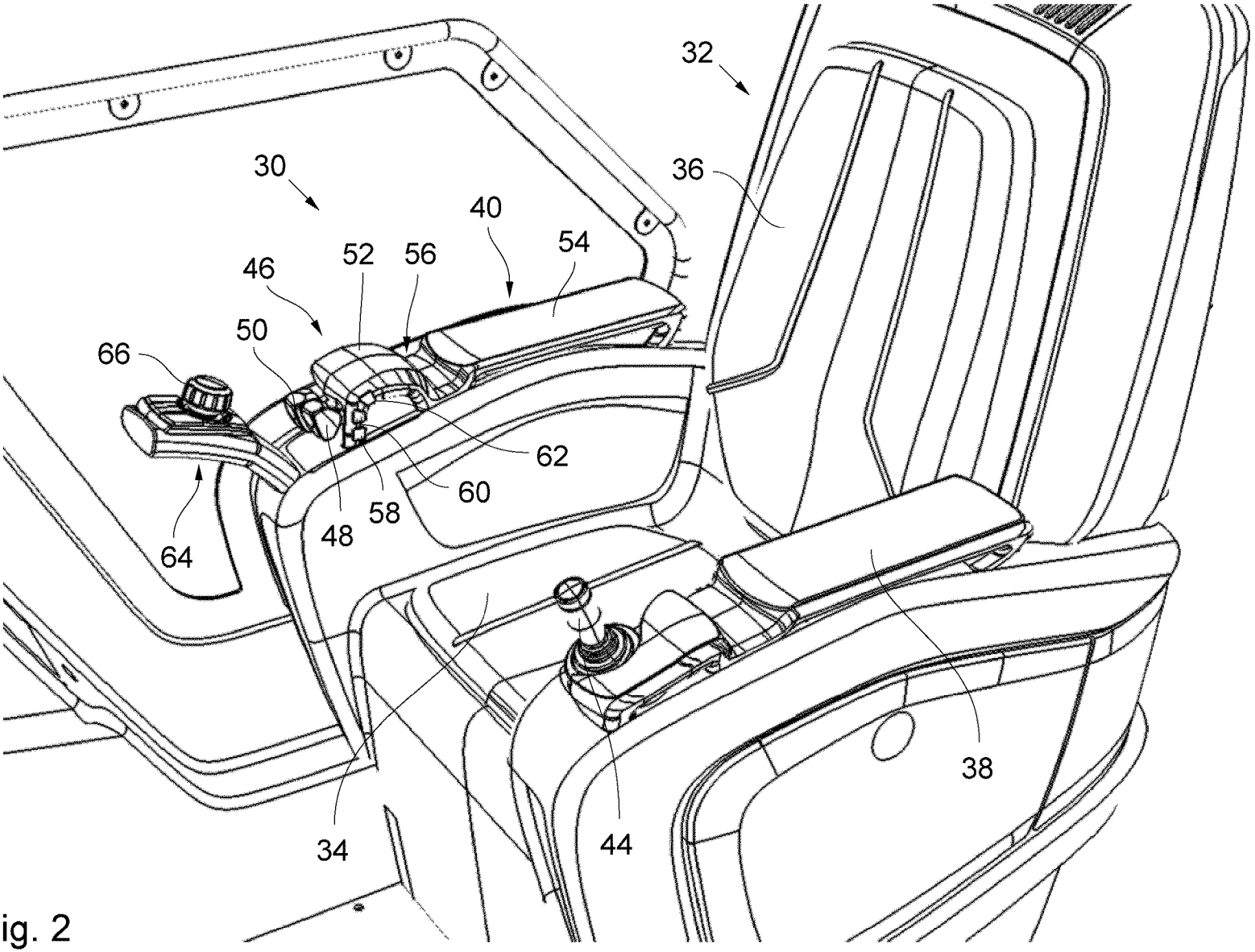
FIGS. 2 and 3 are different views of a control center of the turnable ladder of the firefighting vehicle shown in FIG. 1.
Figure 3:
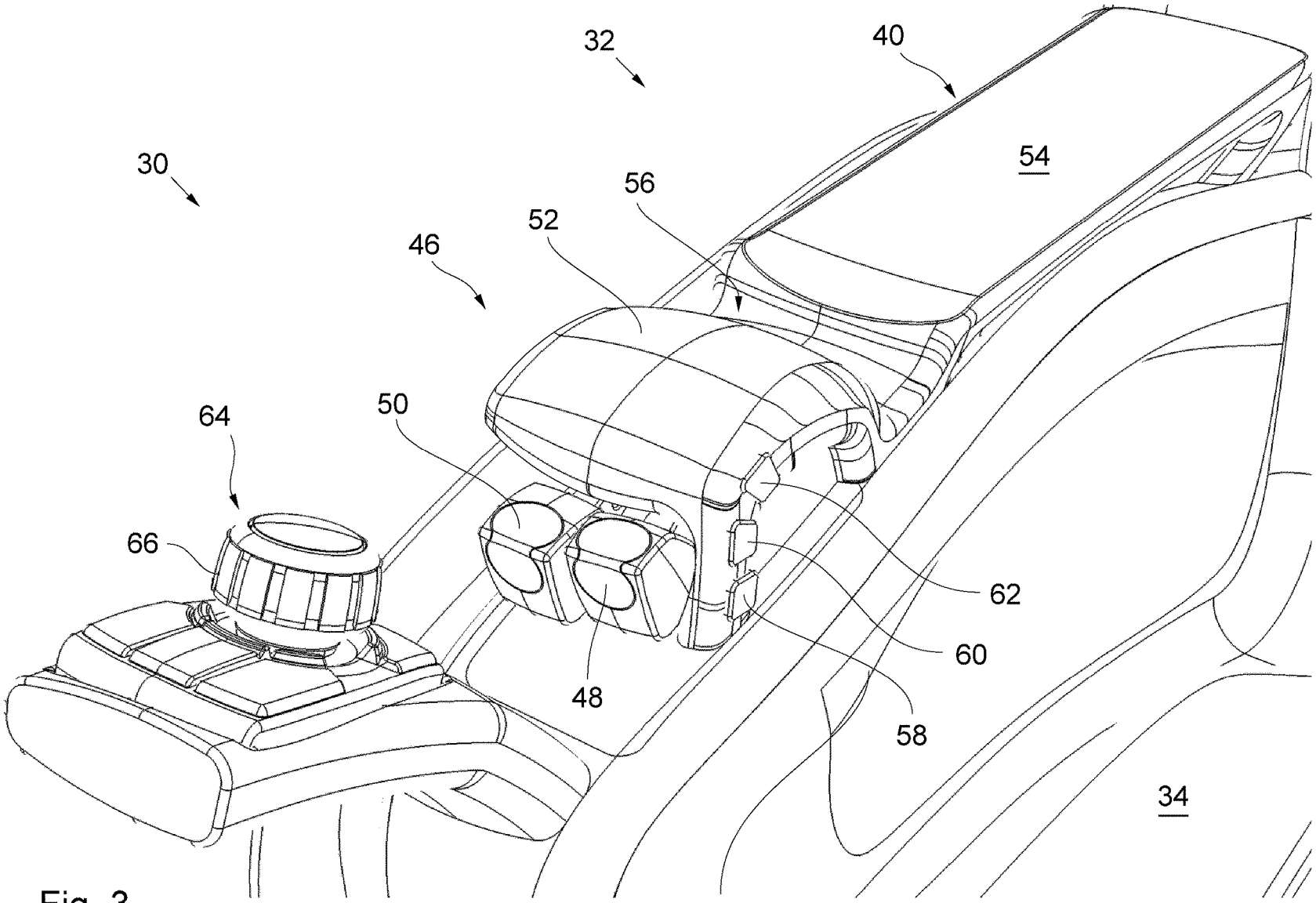

The different movements X1, Y1, X2, L1 and L2 described above can be controlled from a control center 30, which is shown in more detail in FIGS. 2 and 3. The control center 30 comprises an operator's seat 32 on which a human operator can sit. The operator's seat 32 comprises a seating 34, a backrest 36 disposed at the rear end of the seating 34, and left and right armrests 38,40 disposed laterally at opposite sides of the backrest 36.

The armrests 38, 40 are positioned such that a human operator sitting on the seating 34, with his back resting on the backrest 36, may lay down his forearms in a comfortable position on top of the respective backrests 38, 40. This allows a comfortable working position for the operator, with the top end, in particular the rescue cage 42 at the front top end of the extension boom part 22 in his field of view, to monitor all parts of the turnable ladder 12.

The control center 30 comprises two different control devices mounted on its left and right side in front of the respective armrests 38, 40. A first control device of these two control devices is a joystick 44, which is a control lever tiltable around two control axes perpendicular to each other, namely in the left/right direction, and in a front/back direction. The joystick 44 is mounted in a position that the operator can operate it with his/her left hand or finger(s) when his/her forearm rests on the left arm rest 38. It is noted here that the expressions "left", "right", "front" and "back" refer to the perspective of the sitting position of the operator.

The second control device 46 is positioned at the front end of the right arm rest 40. The second control device 46 comprises two different control levers, namely a first control lever 48 and a second control lever 50 disposed next to each other in a position protruding in a forward direction from a bulge 52 at the front end of the arm rest 40, representing a handrest. The bulge 52 bulges in an upward direction and is separated from a rear flat portion 54 of the armrest 40 by a depressed portion 56 with a U-shaped cross-section. The overall shape of the armrest 40, with the rear flat portion 54 to rest the right forearm of the operator on and the bulge 52 as a handrest allows a comfortable working and controlling position for the operator. With the hollow inner surface of his/her hand resting on top of the bulge 52, the operator's fingers may rest on the first control lever 48 and second control lever 50 also in a comfortable position. In particular the index finger of the operator may rest on the first control lever 48 on the left side of the second control device 46, while his/her middle finger may rest on the second control lever 50.

The first control lever 48 and the second control lever 50 comprise horizontal tilting axes that are identical to another in the present embodiment, although it is possible that these axes are not identical but parallel, or they include a small angle between each other. The axes are located in the vicinity of the upper surface of the bulge 52 such that they are as close as possible to the finger joints of the operator. Thus each of the first control lever 48 and second control lever 50 is tiltable in a downward/rearward movement by pressing it down with the respective finger, and in an opposite upward/rearward movement by releasing it or by pulling it with the respective finger. It is possible but not necessary that each of the first and second control levers 48, 50 is restored into a predetermined neutral position by a restoring force when no pushing or pulling force acts on the respective first or second lever 48, 50, and the operation of the lever 48, 50 is only possible against this restoring force.

As will be further explained in the following, the joystick 44 as the first control device and the second control device 46 comprising the first control lever 48 and the second control lever 50 are configured to control the different movements X1, X2, Y1, L1 and L2 of the turnable ladder 12, as explained above with respect to FIG. 1.

Figure 4:
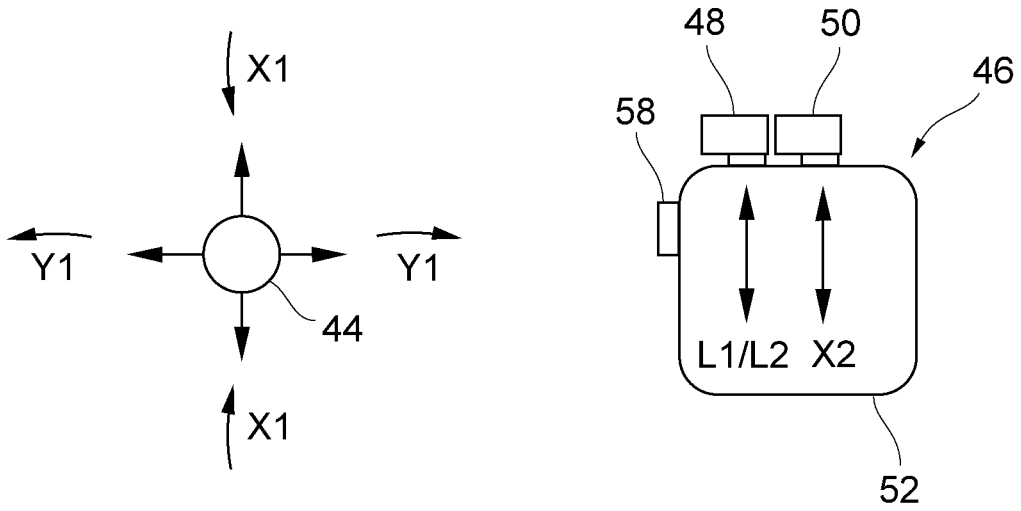
FIG. 4 is a schematic view demonstrating the allocation of the different movements of the control devices of the control center shown in FIGS. 2 and 3 to the different degrees of freedom shown in FIG. 1.

The joystick 44 is configured to control the first inclination movement X1, i. e. the inclination of the main boom part 14, by pushing or pulling the joystick 44 around its horizontal traverse axis, as demonstrated in the scheme in FIG. 4 on the left side, showing the joystick 44 schematically from the top. Moreover, a left/right tilting movement of the joystick 44 controls the rotation of the main boom part 14 around the turret 16, i. e. the rotation movement Y1 in opposite directions. Pushing the joystick 44 to the left/right side corresponds to a swiveling movement of the main boom part 14 to the left/right side, respectively, while pushing or pulling the joystick 44 in the front/rear direction corresponds to lifting or lowering the second end 18 of the main boom part 14.

The first control lever 48 of the second control device 46 (shown schematically in the right portion of FIG. 4) is configured to control the first telescopic movement L1, i. e. the extension or retraction of the main boom part 14. Pushing the first control lever 48 in a front/downward direction may correspond to a telescopic extension of the ladder set representing the main boom part 14, while pulling the first control lever 48 by the index finger in the opposite upward/rear direction may correspond to the retraction of the main boom part 14. With other words, by controlling the first control lever 48, the length of the main boom part 14 is changed by controlling the first telescopic movement L1.

In the present embodiment, the first control lever 48 is configured not only for controlling the first telescopic movement L1 of the main boom part 14 but also for controlling the second telescopic movement L2 of the extension boom part 22. For this purpose the operation mode of the first control lever 48 can be switched between two different modes, namely a first operation mode in which the first telescopic movement L1 is controlled, as described above, and a second mode in which the second telescopic movement L2 is controlled. Only one of these first and second operation modes is active at the same time. The switch for changing the operation mode is represented by a push button 58 disposed laterally at the inner side of the bulge 52 representing the front end of the armrest 40. When the push button 58 is pressed by the operator's thumb, the operation mode of the first control lever 48 is switched into the second operation mode, in which the second telescopic movement L2 of the extension boom part 22 is controlled. When the first control lever 48 is pushed in a front/downward movement with the push button 58 being pushed, the extension boom part 22 is extended in the second telescopic movement L2, while pulling the first control lever 48 in the rear/upward direction retracts the extension boom part 22. In the released state of the push button 58, the first control lever 48 is operated in the first operation mode for controlling the first telescopic movement L1 of the main boom part 14, which has been described above and shall not be repeated here.

The second control lever 50 is configured to control the second inclination movement X2, i. e. the inclination of the extension boom part 22 around the hinge axis of the hinge mounting 24 with respect to the main boom part 14. By pushing the second control lever 50 with the middle finger in the front/downward direction, the free end of the extension boom part 22 (carrying the rescue cage 42 in the present embodiment) is lowered, while pulling the second control lever 50 in the opposite upward/rearward direction lifts the free end of the extension boom part 22.

The control movements of the first control lever 48 and the second control lever 50, i. e. the tilting movements of the respective control levers 48, 50 around their respective horizontal tilting axes, correspond to the actual movement of the controlled element, i. e. the main boom part 14 and the extension boom part 22 in an intuitive way. The first control lever 48 and the second control lever 50 can be operated completely independent from another. However, their control is not complex or demanding under the aspects of coordination of the different movements. It is possible to interchange the assignment of the different first and second control levers 48, 50 to the respective first/second telescopic movements L1/L2 and the second inclination movement X2, such that the first control lever 48 on the left side of the second control device 46, to be operated by the right index finger of the operator, is configured to control the second inclination movement X2, while the second control lever 50 is configured to control the first/second telescopic movements L1/L2.

Figure 5:
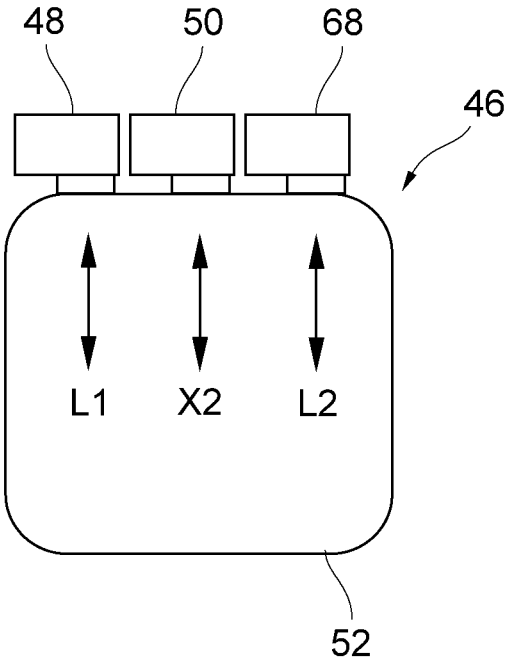
FIG. 5 is a schematic view of a control device of a control center according to a second embodiment of the present invention.

In a second embodiment shown schematically in FIG. 5, the second control device 46 may comprise other control means for controlling the second telescopic movement L2. In particular, the second control device 46 may comprise a third control lever 68 disposed next to the first control lever 48 and the second control lever 50, or between them. This third control lever 68 may be disposed for controlling the second telescopic movement L2 in the same way as described above with the first control lever 48 in the second operation mode in the case of the first embodiment shown in FIGS. 1 to 4. In this case no switching of the first control lever 48 is necessary, but the second telescopic movement L2 is controlled by its own (third) control lever 68, while only the first telescopic movement L1 is controlled the first control lever 48.

In still another embodiment of the present invention, the length of the extension boom part 22 may be fixed, i. e. no second telescopic movement L2 for extending or retracting the extension boom part 22 is possible. In this case a control means for controlling a second telescopic movement L2 is dispensed from the second control device 46, and no switch 58 for changing an operation mode of a control lever or another control lever for controlling the second telescopic movement L2 is present.

As it is demonstrated in FIG. 2 and in particular in FIG. 3, further switches 60, 62 may be present laterally at the inner side of the armrest 40 or the bulge 52 forming the handrest, next to the push button 58 for changing the operation mode of the first control lever 48. In the present case, the additional switch 60 is for activating/deactivating a movement restriction of the aerial device 12. Another additional switch 62 is for activating/deactivating a communication function of the aerial device. These functions may not be understood as limiting, and other functions can be assigned to the different additional switches 60, 62. Also their number and position at the armrest or bulge 52 may vary.

A third control device 64, independent from the first control device and the second control device 46, is disposed in front of the second control device 46 for controlling the operation of a display (not shown) in the viewing field of the operator, in front of the operator's seat 32. This third control device 64 comprises a knob 66 which can be turned into opposite directions around a turning axis, and which can also be tilted around two perpendicular axes, like the joystick 44, to perform different control functions assigned to the display. These functions shall not be described further here.

Both control levers 48, 50 present in the first embodiment shown in FIGS. 2, 3 and 4, as well as all control levers 48, 50, 68 present in the second embodiment shown in FIG. 5, are arranged next to each other in a row, protruding in the same direction parallel to each other from the bulge 52, to be operated by the operator's different fingers. Although not shown, it is possible to arrange a separating element between the different control levers 48, 50, 68 which does not obstruct the operability of the control levers 48, 50, 68 but makes it easier to identify each lever haptically, to avoid mixing up the different control levers 48, 50, 68.

It is possible to provide all control levers 48, 50, 68 as proportional control devices, in which the respective lever displacement is proportional to the movement speed. It is also very common to provide such a control lever 48, 50, 68 as to return into a neutral position with no pressing or pulling force being applied to the lever, and the control lever 48, 50, 68 must be operated against a restoring force.

According to an embodiment of the present invention not demonstrated in the figures, the aerial device does not comprise an extension boom part at the end of the main boom part. In this case the second control device may comprise only one control lever, corresponding to the first control lever 48 of the second control device 46 described above, for controlling the first telescopic movement L1 of the main boom part, while the second control lever can be dispensed.

According to still another embodiment of the present invention, in which the aerial device comprises the extension boom part, the second control device comprises a control lever for controlling the first telescopic movement L1 of the main boom part in a first operation mode and for controlling the second inclination X2 of the extension boom part in a second operation mode, and a switch for changing the operation mode, i.e. for switching between the first and the second operation mode.

According to still another embodiment of the present invention, in which the extension boom part can be extended and retracted, as in the embodiment shown in FIGS. 1 to 5, the third control lever 68 may be dispensed but an additional switch may be disposed at the second control device for switching either one of the first control lever 48 and the second control lever 50 (FIG. 5) from its respective operation mode, i.e. for controlling the first telescopic movement L1 or the second inclination X2, respectively, to a third operation mode for controlling the second telescopic movement X2.

The invention claimed is:

1. A control center for an aerial device, said aerial device comprising:

a main boom part mounted with a first end on a turret;

an extension boom part mounted to a second end of the main boom part, wherein the main boom part is:

inclinable around a horizontal axis in a first inclination movement, rotatable around a vertical axis in a rotation movement, and extendable and retractable along a main boom longitudinal extension direction in a first telescope movement, wherein the extension boom part is extendable and retractable along its an extension boom longitudinal extension direction in a second telescopic movement, wherein the control center comprises a first armrest having a rear flat portion and a first control device in front of the rear flat portion, a second armrest in opposed relation to the first armrest and having a rear flat portion and a second control device in front of the rear flat portion, the first and second control devices are configured to be operated manually and independent from one another, the first control device being configured for controlling the first inclination movement and the rotation movement of the main boom part, and the second control device comprising at least a first control lever for controlling the first telescopic movement and the second telescopic movement;

wherein the control center comprises a switch for changing an operation mode of the first control lever from a first mode of controlling the first telescopic movement to a second mode in which the second telescopic movement is controlled;

wherein the extension boom part is associated to the second end of the main boom part by a hinge mounting and being inclinable around a horizontal hinge axis with respect to the main boom part in a second inclination movement, and the second control device comprises control means for controlling the second inclination movement;

wherein the control means for controlling the second inclination movement comprise a second control lever for controlling the second inclination movement;

wherein the control means for controlling the second inclination movement comprise said switch for changing said operation mode of the first control lever; and wherein the switch for changing an operation mode of the first control lever or the second control lever is disposed laterally at an inner side of the first or second armrest or a handrest.

2. The control center according to claim 1, wherein the second control device is disposed at a front end of the second armrest.

3. The control center according to claim 2, wherein the front end of the second armrest comprises a bulge representing the handrest.

4. The control center according to claim 1, wherein the second control device comprises at least one additional switch disposed laterally at an inner side of the second armrest or the handrest.

5. The control center according to claim 4, wherein the at least one additional switch is a movement restriction control switch for activating/deactivating a movement restriction of the aerial device or a communication control switch for activating/deactivating a communication function of the aerial device.

6. The control center according to claim 1, comprising an operator's seat, with a backrest and said first and second armrests disposed laterally at two opposite sides of the backrest, with the first control device being disposed at the first armrest, and the second control device being disposed at the second armrest.

7. The control center according to claim 1, wherein the first control device comprises a joystick.

8. The control center according to claim 1, wherein the aerial device comprises a turnable ladder of a firefighting vehicle, and wherein the control center controls the turnable ladder.

9. The control center according to claim 1, wherein the switch includes a push button.

* * * * *